US009856653B1

(12) United States Patent
Smith

(10) Patent No.: US 9,856,653 B1
(45) Date of Patent: Jan. 2, 2018

(54) MODULAR PRECAST CONCRETE STEPS

(71) Applicant: William H Smith, Manlius, NY (US)

(72) Inventor: William H Smith, Manlius, NY (US)

( * ) Notice: Subject to any disclaimer, the term of this patent is extended or adjusted under 35 U.S.C. 154(b) by 0 days.

(21) Appl. No.: 15/704,884

(22) Filed: Sep. 14, 2017

Related U.S. Application Data

(63) Continuation-in-part of application No. 15/386,002, filed on Dec. 21, 2016.

(60) Provisional application No. 62/295,529, filed on Feb. 16, 2016.

(51) Int. Cl.
*E04F 11/00* (2006.01)
*E04F 11/035* (2006.01)
*E04F 11/116* (2006.01)

(52) U.S. Cl.
CPC ..... *E04F 11/035* (2013.01); *E04F 11/116* (2013.01)

(58) Field of Classification Search
CPC ..... E04F 11/116; E04F 11/035; E04F 11/022; E04F 11/025; E04F 11/09; E04F 2011/0212
See application file for complete search history.

(56) References Cited

U.S. PATENT DOCUMENTS 1,265,949 A * 5/1918 Osborn ..... E04F 11/022 52/189
1,497,058 A * 6/1924 Barriball ..... E04F 11/025 52/190
1,861,751 A * 6/1932 Nicols ..... E04F 11/035 52/189
1,963,866 A * 6/1934 Peterson ..... E04F 11/022 249/14
2,044,260 A * 6/1936 Schiele ..... E04F 11/022 52/184
2,171,951 A * 9/1939 Rosenberger ..... E04F 11/022 52/189
2,615,325 A * 10/1952 Seeber ..... E04F 11/022 52/190
2,697,931 A * 12/1954 Schill ..... E04F 11/025 52/189

(Continued)

FOREIGN PATENT DOCUMENTS

JP 2008111290 A * 5/2008

*Primary Examiner* — Gisele D Ford
(74) *Attorney, Agent, or Firm* — Bernhard P. Molldrem, Jr.

(57) ABSTRACT

A precast concrete step unit formed of left and right sidewalls, risers, and treads, wherein left and right sidewalls are assembled from a plurality of pre-cast sidewall panel modules, with a stepped panel module with two or more steps. Pre-cast concrete riser modules and tread modules extend between the right and left sidewalls. Reinforcing cross brace members are fastened to the inside distal surfaces of the left and right sidewalls where they are bolted into screw anchors embedded into the sidewalls. There are also screw anchor inserts embedded into the proximal ends of the sidewalls and into the ends of a first or lowest of the risers, and adapted for affixing the riser and sidewalls using clip angles or right-angle brackets. After alignment, the treads and remaining risers are installed using a construction adhesive which may be applied using a caulk gun. The precast modules each weight about 200 pounds or less, with none exceeding 250 pounds, and most much less. The installation can be carried out by an installation team of two workmen. One-piece concrete footing pieces can be used to support the lower edges of the sidewall panel modules.

9 Claims, 6 Drawing Sheets

(56) References Cited

U.S. PATENT DOCUMENTS

| | | | | | |
|---|---|---|---|---|---|
| 2,722,823 | A * | 11/1955 | Summers | E04F 11/022 | 52/189 |
| 2,885,883 | A * | 5/1959 | Torricelli | E04F 11/022 | 52/189 |
| 3,025,639 | A * | 3/1962 | Lemieux | E04F 11/022 | 52/189 |
| 3,055,146 | A * | 9/1962 | Lobato | B28B 7/225 | 249/14 |
| 3,706,170 | A * | 12/1972 | Argraves | E04F 11/022 | 52/182 |
| 4,042,064 | A * | 8/1977 | Lobb | E01F 1/00 | 182/115 |
| 4,328,651 | A * | 5/1982 | Gutierrez | E02D 27/02 | 52/169.9 |
| 8,627,926 | B2 * | 1/2014 | Gordon | E04F 11/02 | 182/115 |
| 2004/0040229 | A1 * | 3/2004 | Torch | E04F 11/116 | 52/189 |
| 2004/0040785 | A1 * | 3/2004 | Robinson | E04F 11/025 | 182/115 |
| 2007/0261324 | A1 * | 11/2007 | Munson | E04F 11/116 | 52/177 |
| 2009/0056253 | A1 * | 3/2009 | Davis | E02D 27/16 | 52/292 |

* cited by examiner

MODULAR PRECAST CONCRETE STEPS

This is a continuation-in-part of Ser. No. 15/386,002, filed Dec. 21, 2016, pending, and claims priority under 35 U.S.C. 119(e) of provisional patent application Ser. No. 62/295,529, filed Feb. 16, 2016, the disclosures of which are incorporated by reference herein.

BACKGROUND OF THE INVENTION

The present invention relates to pre-cast concrete articles, and in particular to pre-cast concrete steps that can be used at the entrance to a home or other building structure.

Typically, present-day concrete steps are molded or formed as a one-piece unit; at a factory or central work site, and are delivered in that form to the job site for installation on a building. These one-piece units are quite heavy, e.g., 2,000 pounds or more, and they require a crane or other heavy equipment to lift and move them to the proper location. In many cases it is not practical to bring the heavy equipment to the location where the steps are to be installed, and this can create a large additional expense. Also, most manufacturers produce only a limited variety in terms of style and size, ie., height and width of the precast steps, and the selection may or may not include steps that are correct for the given building. Further, the steps are limited in available designs, surface textures, or other features that a customer may want for the project.

OBJECTS AND SUMMARY OF THE INVENTION

In order to address these shortcomings, the inventor herein is proposing a modular system of assembling pre-cast concrete steps on-site, using pre-fabricated side wall panel modules, riser modules, tread modules, and platform modules. These pre-cast concrete modules are designed to weigh not more than 250 pounds, preferably about 200 pounds each, or less, so that one or two installation workers can easily carry each module from a truck bed to the installation location. These pre-cast panel modules, tread modules, riser modules, etc. can have any desired surface texture (e.g., natural rock finish, smooth finish, sand finish, etc.) and in the customer's choice of color or style (e.g. bull-nose treads). By using more or fewer side panels the side walls of the steps can be made higher (with more steps) or lower (with fewer steps) and can have a long or short platform behind the top step. A third side panel wall, identical to the left or right side walls, can be placed between the two side walls as a support for wider risers and treads, i.e., supporting longer spans and permitting construction of extra-width steps.

The steps can be installed using internal brackets, bracing, and doweling, to make the steps suitable for long service. The modular system makes it possible to replace worn or damaged side panels, risers, or platform modules, rather than replacing an entire step unit.

The modular precast concrete steps that may be constructed according to the main principles of this invention, are shown in the attached drawing figures. This type of modular step unit allows anyone to assemble it, with any desired amount of rise and at any width, and with or without a platform.

Riser heights can be made shorter than standard to allow for different building codes or to accommodate elderly persons. Greater widths can be obtained by adding one or more center supports, in the form of an additional side wall unit to decrease the span for the risers and platforms.

Railings can be bolted to the top of the treads and the platforms. Most or all the individual modules do not exceed 250 pounds, and can be handled by two persons.

Modular components can be doweled and aligned with or without a "V" or ship-lapped joint. The modules can be joined using a standard mortar, but could be permanently glued with a construction adhesive. Alternatively, the modules may be held together using dowels and bolts, so that the stair unit can be disassembled (at least in part), e.g., to repair or replace a damaged stair tread or wall panel.

The components can be reinforced with fiber and/or steel. The inner surfaces of the risers, treads, side wall panels, and platform panels can be embossed, i.e., recessed in places, so as to relieve some of the weight of the module without loss of strength.

Decorative designs may be incorporated into the surface of the side wall modules as well as treads, risers, e.g., stone, brick, stucco surfaces, etc., and these can be color treated as desired.

Cross bracing can be easily installed to align side wall panels and can give extra stability to higher units. Steel, plastic, or composite reinforcing plates can be used to align the components on larger units and achieve increased stability.

In a preferred mode, the step unit is provided in the form of a kit that can be assembled on-site at a remote location away from the plant or factory, requiring only two persons to complete assembly and requiring only simple tools, such as a wrench, a hammer, a level, and a caulk gun.

The kit includes both a left pre-cast stepped sidewall and a right pre-cast stepped sidewall, each formed of one or more concrete wall panels, and each having a proximal or lower portion and a distal or higher portion which faces against the building. The stepped sidewalls define alternate vertical and horizontal edge surfaces for the risers and treads.

a first pre-cast concrete riser module is dimensioned to extend between the left and right sidewalls and at least a second pre-cast concrete riser module is dimensioned to extend between left and right sidewalls; the riser modules being configured to be attached against the vertical edge surfaces. Likewise, pre-cast concrete tread modules are adapted to extend between the left and right sidewalls and to be attached onto the horizontal edge surfaces.

A pair of cross-brace members adapted for joining the left and right side walls within the distal portions thereof, and each of the cross-brace members has a foot member at each end thereof with a bolt hole therein to receive a threaded fastener. The cross-brace members of each pair are pivotally joined at a mid portion. The kit also includes a sufficient number of right angle brackets, each being in the form of a rigid plate with portions joined at a right angle bend, and each portion having a pair of bolt holes. The kit also includes a sufficient number of bolts or similar threaded fasteners, and a tube of construction adhesive that can be applied using a caulk gun.

In this arrangement the side walls each have a pair of screw anchors embedded therein at the proximal portion thereof, and a pair of screw anchors embedded at the distal portion thereof. The first riser module also has a pair of said screw anchors embedded at each end and to fasten the right angle brackets at the inside front corners where the proximal portions of said side walls join to the respective ends of said first riser member.

Once the cross-brace members and the first riser member have been installed, and the installation personnel have taken care to ensure that the structure is properly squared and leveled, the remaining riser members and tread members can be affixed to the side walls by applying the bonding agent onto the horizontal and vertical surfaces of the side walls and to the upper edges of the riser members.

As each of the concrete members weighs no more than 250 pounds, and many parts less than 25 pounds, the step can be assembled and completed using only two persons, and installation can be completed in an hour or less in many cases.

Thereafter, the concrete members can be treated with a protective coating, or can be stained to a desired cover. Also, rails can easily be installed on one or both sides.

The risers and side walls can be molded to have a shorter vertical distance between steps, so as to facilitate use by persons with motion disabilities or elderly persons.

Features and Advantages of Modular Concrete Steps

The major features and advantages of this invention are as follows:

The steps can be customized for different size spaces and different size concrete slabs.

The panels can be joined with key-way joints or pinning. Pins or dowels can be used to secure the panels of the side walls. The side wall modules or sections can be bolted together using bolt plates to secure the modules to one another. X-bracing inside the step between the side walls help align the side walls.

Reinforcing ribs on treads, risers, and platform slabs strengthen these components or modules where needed, and recesses can be provided to reduce weight of the components without a loss in strength.

Brick, stone, or plain finishes are available for risers.

Different style of noses are available for the treads, e.g., chiseled stone, square, bullnose, etc. The treads may have different styles and finishes also, e.g., plain, broomed, stone, non-skid, etc.

Embossed indents or recesses relieve some of the weight of the modules, without compromising strength.

Sides, risers, treads, and platform slabs can be made at the factory or shop and shipped as a kit to the customer's property where the modules are assembled and installed. The parts are selected so the step unit is a custom fit. Each part is limited in weight so that the modules can each be carried by and installation team of two workmen.

The sides which define the stepped front edge or stringer for holding the risers and treads can be made of two or more panels, and can be held together using a concrete adhesive and/or mechanical bracing. Tread and riser can be formed as unitary panels, rather than separate riser panels and tread panels, such that they seat on the stepped edge of the side walls. Additional platform panels can extend the concrete porch steps back beyond the top step tread.

Higher, multiple deck concrete steps can also be constructed with several flights of steps and a deck or landing between flights.

Side rails can be easily installed on one or both sides of the step units.

Molded concrete foot pieces may be used to support the modular step unit on ground rather than on a poured concrete slab, where the unit will be less susceptible to frost heave.

DETAILED DESCRIPTION

Figure 1:
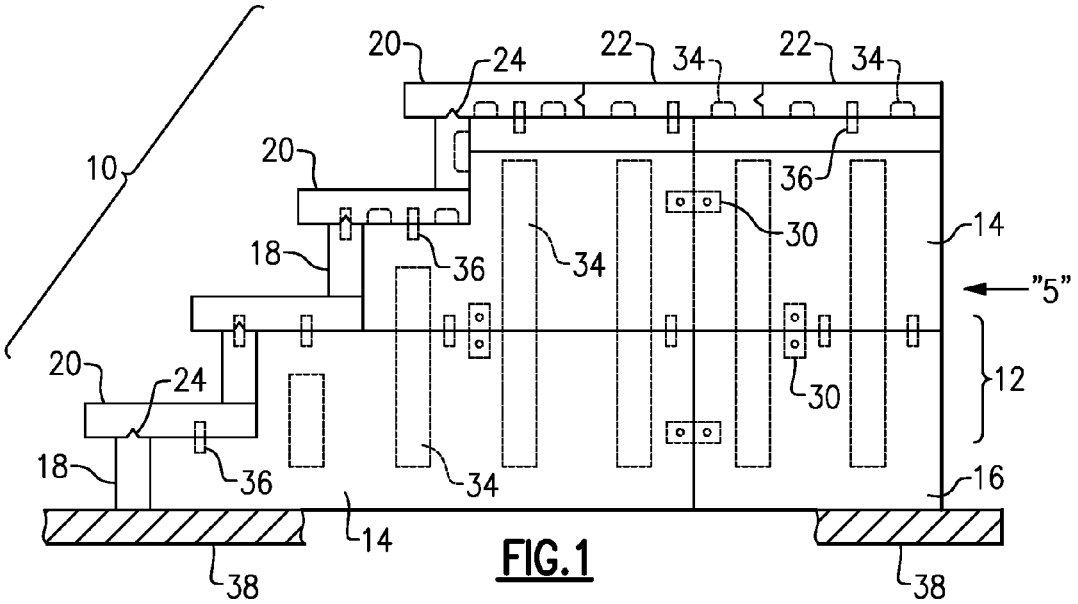
FIG. 1 is a side elevation, partly in broken line to show features on the reverse side of the side wall, of a modular concrete step of the present invention.

FIG. 1 shows the step unit 10 having a side wall 12 being formed of an assembly of two modular stepped side modules 14, 14 staggered in position, and a square or rectangular modular panel 16 at the back end of the lower module 14. Also shown are the riser modules 18 and steps or tread modules 20, and a pair of platform tread modules 22 in place behind the top step tread. A key-way 24 can be fitted into a mating recess in the tread module to lock in place the riser module 18 to the supported tread module 22. Note that there can be recesses or cutouts 34 (shown in broken line) formed on the under side of the modules 22 and on the inward sides of the side wall modules 14, 16, that serve to relieve some of the weight of the tread module 20 and side wall module without any loss in strength of the module. Also shown here, pins or dowels 36 are configured for fitting into corresponding recesses or sockets in the side wall panels, and are intended for joining the tread modules to the walls and also joining a platform slab base 38 unit to the bottom edge of the side walls. The pins and dowels 36 are oriented vertically and fit into respective complementary ones of said recesses, with recesses being located on edge surfaces of the respective pre-cast concrete sidewall panels.

Figure 2:
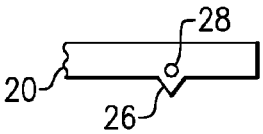
FIG. 2 shows a tread in cross-section to reveal a reinforcing rib and re-rod.
Figure 3:
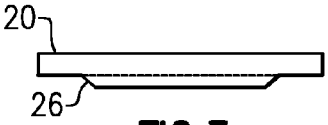
FIG. 3 is a front view of the tread with reinforcing rib.
Figure 4:
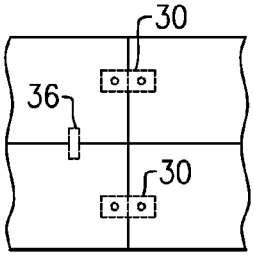
FIG. 4 shows a portion of the reverse side of the side wall shown in FIG. 1, featuring bracket plates holding several modular panels together.
Figure 5:
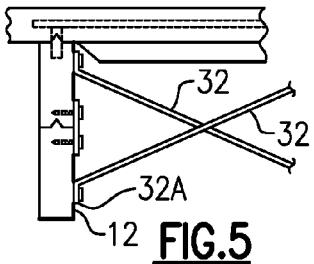
FIG. 5 is a partial rear view, taken at "5" in FIG. 1, showing an X bracing or cross-bracing feature.
Figure 6:
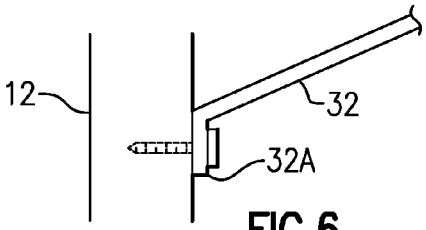
FIG. 6 is a partial enlargement of a portion of FIG. 5 showing a portion of the steel cross brace bolted to one side-wall module.

As shown in FIGS. 2 and 3, the treads 20 can have a transverse reinforcing rib 24 and a reinforcing steel rod 26. As shown in FIG. 4, steel plates 30 can be fastened, e.g., with bolts, across the seams joining adjacent side wall panel modules. These plates 30 are affixed onto the inward side of the step unit. As shown in FIG. 5, the steel reinforcing plate 30 favorably spans across a seam between adjacent side panel members and is bolted to the respective panel members on either side of the seam. In addition, cross-bracing 32 is used to brace the left and right side walls 12 to one another to keep the left and right side walls aligned, as shown in FIGS. 5 and 6, with a portion of the steel cross brace member 32 being shown in FIG. 6. Favorably, the cross brace members 32 are arranged in pairs each being a continuous member extending from one wall to the other, with the pair extending along crossed diagonals between the left and right side walls. As shown in FIG. 6, each cross brace member 32 has an angled foot member 32A at each end, which is bolted directly into the respective side wall 12 on its inside surface.

Figure 7:
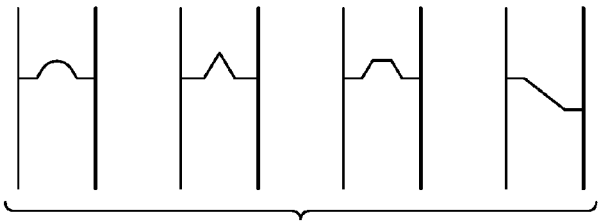
FIG. 7 shows some of the typical joints that may be used for mating side panel modules for the side walls.

FIG. 7 illustrates in cross section a number of possible key-way designs that may be used for aligning and joining the side modules to one another or the tread and platform slabs to one another. These four are illustrative only, and do not limit the shape or profiles to any specific design of key-way. These may permit stacking of modules one above the other, with or without cement or mortar.

Figure 8:
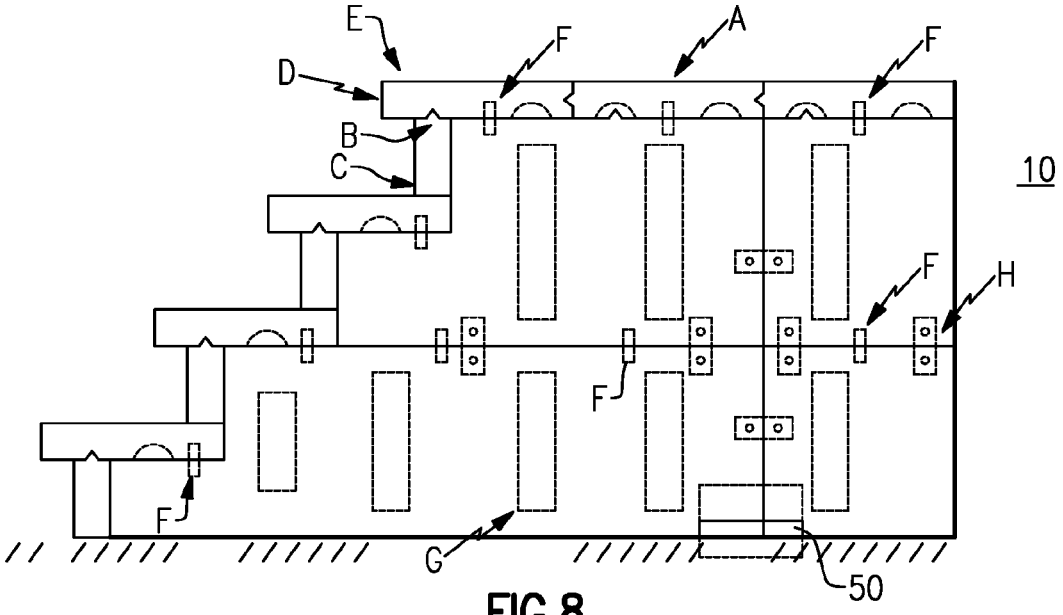
FIG. 8 is a side elevation of another possible modular step assembly.
Figure 9:
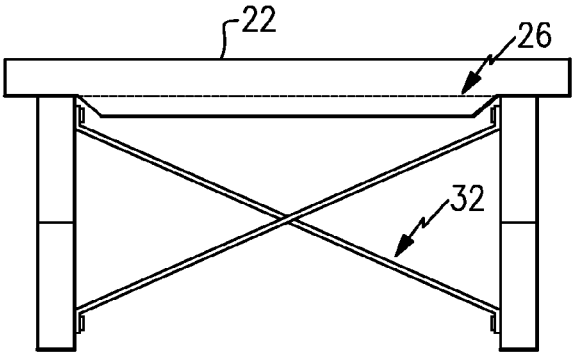
FIG. 9 is a rear view thereof showing the cross-bracing.

FIG. 8 is another side view illustrating another similar embodiment. Upper surfaces E of the stair treads may have a surface treatment to satisfy the customer's desire, e.g. plain, broomed, stone dust, brick face, non-skid, etc. The tread modules may have noses D with any desired amount of overhang, and may be in the form of chiseled, square, bullnose, etc. Pins or dowels F are used to connect the side wall panel modules to one another and to position the stair tread modules and the top platform module, as shown. In some cases where it is envisioned that some modules may need to be removed and replaced, the attachment may be by these pins or dowels F only, not employing mortar or cement at those locations. Also as shown in broken line, the reverse or inner side of the side wall panel modules may have cut-aways or recesses G, i.e., embossments, to relieve some of the weight of the modules. These do not compromise the vertical strength of the assembled step unit. FIG. 9 shows also the top platform module(s) 22 having a lateral reinforcing rib 26 at its underside. This view, from the rear or high end of the assembled step unit, also shows the cross bracing using the steel cross braces 32 at crossed diagonals. There can typically be several pairs of cross brace members from front to back.

Figure 10:
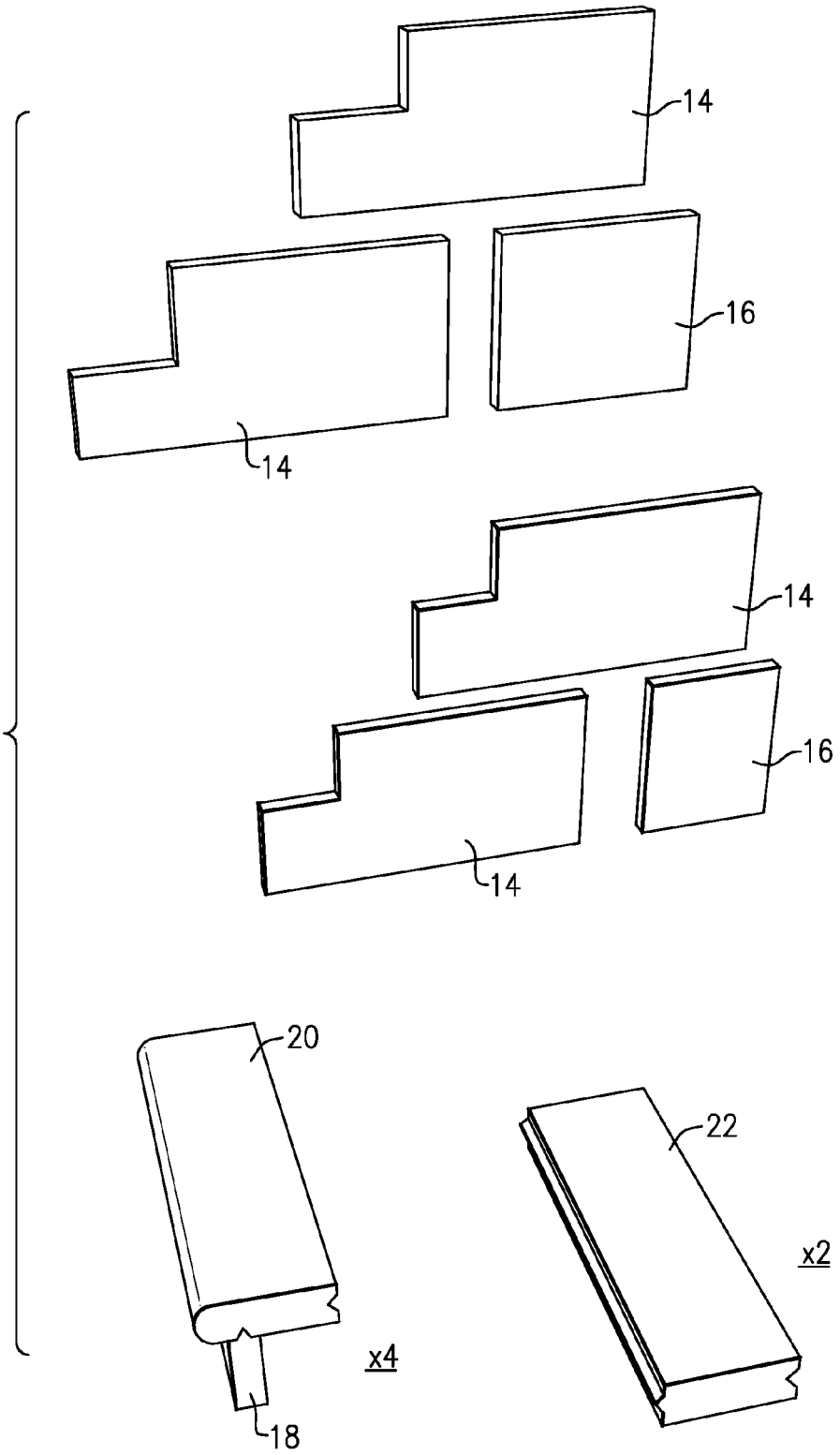
FIG. 10 is an exploded view of the major modular concrete panel elements employed in the construction of the modular step assembly of FIG. 8.

FIG. 10 is an assembly view showing the major concrete modules needed to create the concrete step 10 of this embodiment. Here there are four of the modules 14, two of the modules 16, four each of the risers 18 and treads 20 and two additional top platform slabs 22. For a higher or longer concrete step, a different set of these modules would be needed. In this case each of the modules has a weight of 250 pounds or less, most less than 200 pounds, and each can be carried from the truck to the installation site by hand, carried by two workmen. The modules are interchangeable also, so that any of them can be replaced with a similar module, if need be. The hardware such as the steel plates 30 and the pins or dowels 36 would be included in the kit, but are not shown in this view.

Figure 11:
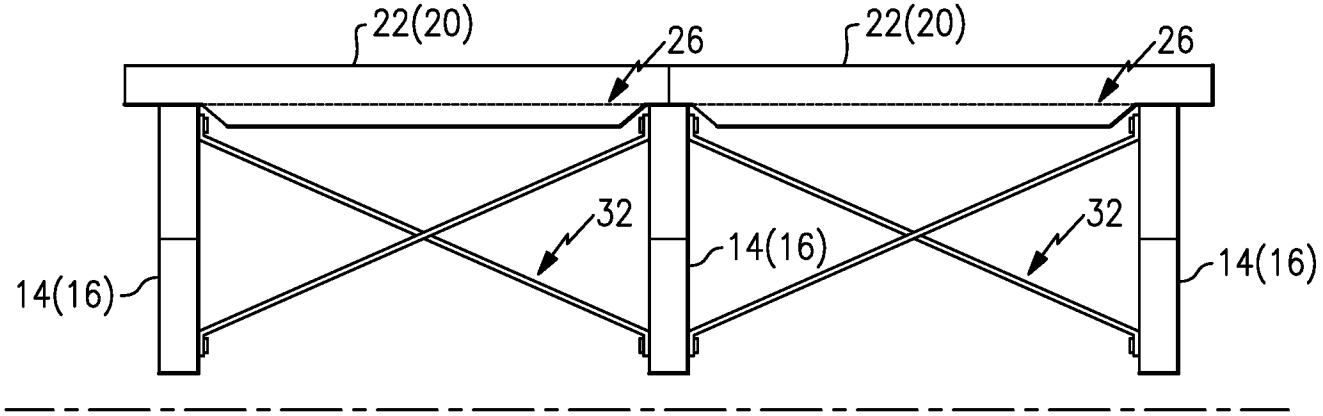
FIG. 11 is a rear view of an alternative, double-width embodiment.

FIG. 11 illustrates a double-width step unit, shown from the same aspect as FIG. 9, and with similar reference numbers identifying similar elements. There are left, right and center stepped walls formed of the wall modules 14 and/or 16, and these support the edges and middle part of the tread modules 20 and 22, which in this case may be double length or, as shown here formed of two modules set in end-to-end. The tread modules are shown here with the optional reinforcing rib 26. The cross brace members 32 are installed as shown here in a rear elevation so as to extend diagonally downward from an upper part of one wall to the lower part of the opposite wall, and shown here with cross-brace members 32 extending between the right side wall and the center wall and also between the center wall and the left side wall.

Figure 12:
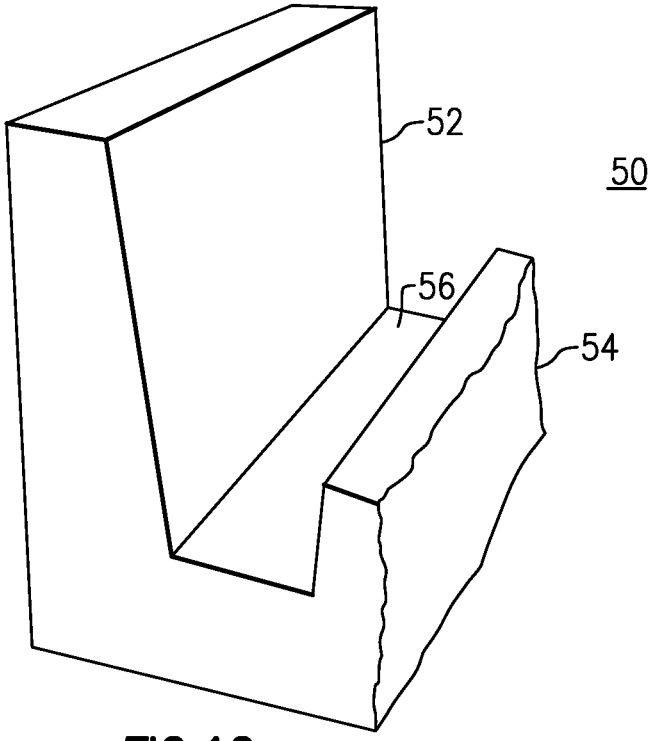
FIG. 12 is a perspective view of a foot piece for the modular step assembly.
Figure 13:
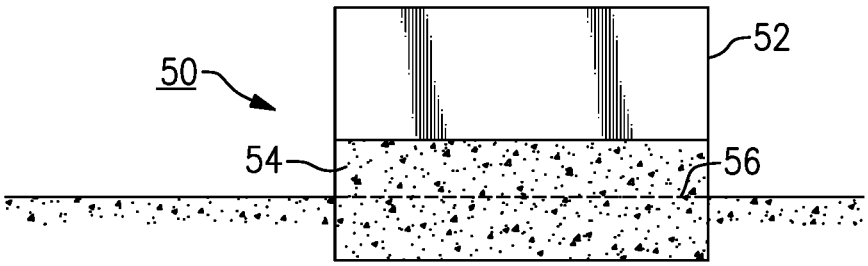
FIG. 13 is an elevation thereof.

A footing piece 50 for supporting the side wall module or modules 14, where there is no poured concrete slab, is shown in FIGS. 12 and 13. Here the footing piece 50 has a vertical back plate 52, a front panel 54 and a base 56. The facing surfaces of the back plate 52 and front panel 54 taper inward to the base 56, and define a tapered slot for the lower edge of the side wall module 14 so it can rest securely on the upper surface of the base 56. These footing pieces 50 are set into the ground, favorably in a gravel layer so that the support surface of the base 56 is at grade level (FIG. 13). The back plate 52 is at the inside of the modular step unit, and the front panel is on the exterior. The front panel can have a textured surface, e.g., simulated stone or as appropriate to match the step unit. A typical step unit may require two or three footing pieces 50 per side. One footing piece 50 is shown at a typical position in FIG. 8.

Figure 14:
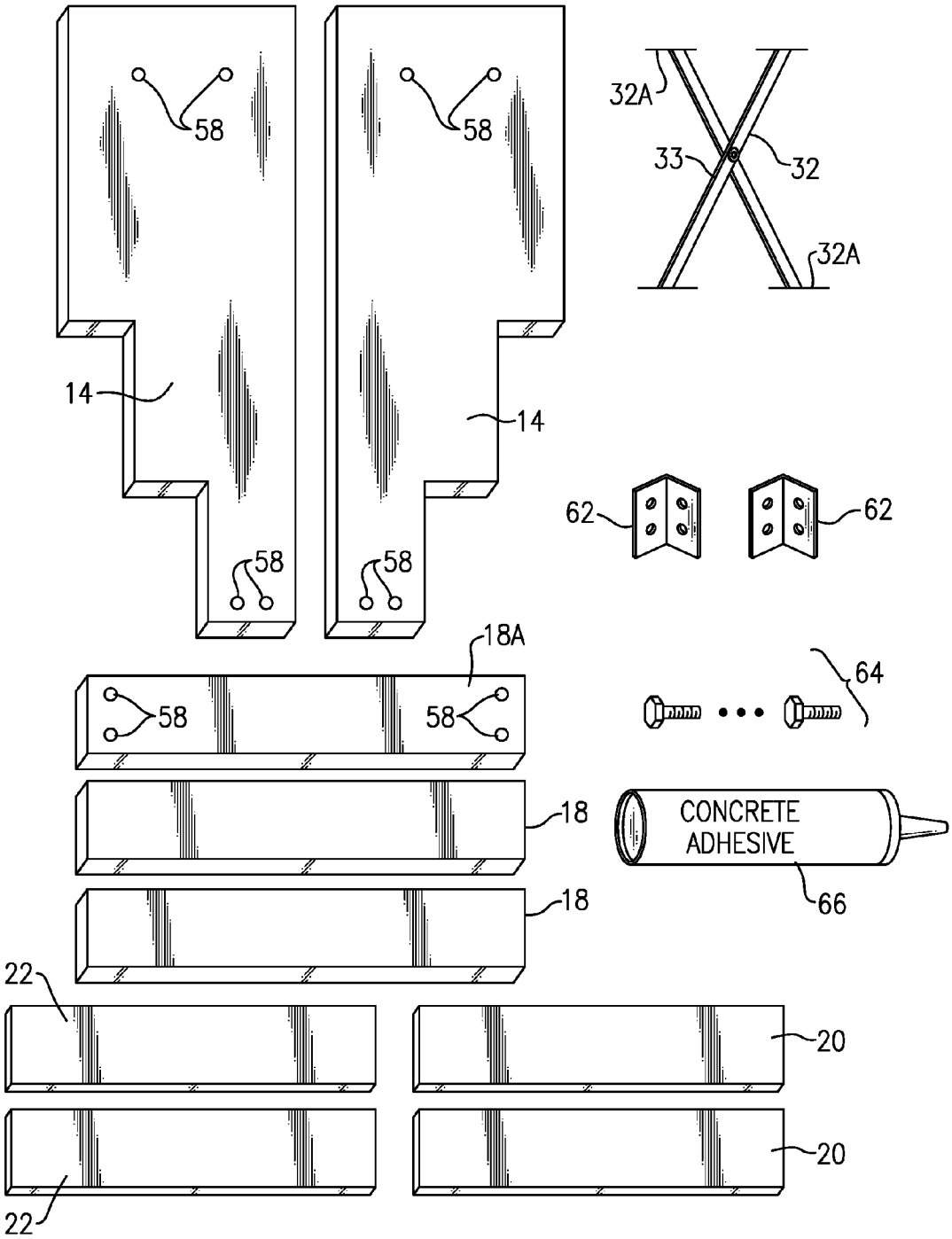
FIG. 14 is an assembly view of a kit of parts necessary for constructing on-site of a pre-cast step unit according to a preferred embodiment of the invention.

The step unit can be constructed on side from a kit containing the required stepped side walls, risers, treads, and reinforcing or bracing members such as X brackets or cross-braces and right angle brackets or clip angles, as shown e.g. in FIG. 14. The kit also favorably includes a tube or cylinder of a suitable construction adhesive for cementing the risers and treads onto the side walls, and bolts or similar threaded connectors to attach the cross-brace member(s) and right angle brackets to the side walls and to the lowest or first riser module. In this case the first riser has threaded anchor members pre-installed at the ends where it can be attached, using the right angle brackets, to the front or proximal ends of the left and right stepped side walls, which also have pre-installed threaded anchors. These screw anchors are also present at or near the distal or building end of the side walls for attachment of the cross-brace members.

In this particular example, there are left and right stepped sidewalls 14, 14 each with three vertical surfaces to accommodate risers and three horizontal surfaces to accommodate tread modules and platform modules. The kit then includes three risers including a first or lowest riser 18A and a pair of additional risers 18, 18, and three tread modules 20 as well a platform module 22. The hardware items included with the kit are an X-brace 32, a plurality of clip angles or right-angle brackets 62, and a quantity of bolts or similar threaded members 64 or pair of cross brace members 32 that are pivotally joined at their mid-portions with a rivet 33 or the like. Each of the cross brace members 32 has a foot 32A at each end with a bolt hole through it, as discussed in respect to FIG. 6. Also included in the kit is a tube 66 or cylinder of a construction adhesive or the type that bonds with concrete products or with stone or other mineral or synthetic construction materials. The construction team can use a standard caulk gun, and load this tube in it to squeeze out the construction adhesive where needed. The construction team would only be required to supply one or two wrenches, a hammer, a level, tape measure, and a caulk gun.

The installation procedure is straightforward, and can be completed within no more than about one hour. All the structural components supplied in the kit are steel or fiber-reinforced concrete, with the kit having the sidewalls, risers and treads sized and in the appropriate number for the given structure and the height of the door threshold where the pre-cast step is to be installed.

The unit may be installed on a concrete slab, or on prepared ground using termite blocks or the sidewall support feet 50 mentioned earlier. Preparation can include leveling the ground and adding a bed of crushed stone for good drainage.

The first step is to measure the doorway, and find the center of the door threshold, and mark it with a pencil. Then measuring from the center mark, the building should be marked at locations corresponding to the width of the step. That is, for a five-foot wide step, the marks should be place at 30 inches from the center mark, on each side. Then from those marks, marks need to be made at locations of the inside of the sidewalls, which for the preferred embodiment would be four inches in from the end marks. Then a line should be drawn vertically to the ground so to mark the locations of the sidewalls 14.

The next step is to lay down the left and right sidewalls in place, with the inside of the walls facing up so the screw anchors or threaded inserts 58 are available. At this time, the cross-brace member 32 is attached, first to the left side wall 14 by placing bolts 64 through the feet 32A of the cross-brace member into the threaded inserts 58 on that side. Then the left and right side walls are tipped up and the other end of the cross-brace member is affixed to the distal portion of the right side wall in the same fashion, affixing the right side feet 32A with bolts 64 into the two threaded inserts 58. Then these bolts can be tightened as needed. At this point, the two sidewalls 14 should be aligned with the marks for the inside of the two sidewalls.

Now, the lowest or first riser 18A is placed at the front vertical edges of the two sidewalls 14, and this is bolted in place using the clip angles or right-angle brackets 62, one at each side, and affixing these with bolts 64 into the threaded inserts 58 at the front part of the side walls and at the ends of the riser 18A.

Using a tape measure the distance diagonally from the distal end of each side wall to the front or proximal end of the sidewall or to the front of the top horizontal surface of the other sidewall is measured. The front riser and sidewalls can be moved left or right as needed until the two measurements are equal, and the sidewalls are properly square to the building and to one another.

Now the two sidewalls can be made level, left to right, as need be using shims (provided in the kit) or other leveling means, and a downward slope of about one-half inch back to front can be established for proper drainage of rainwater. After this the sidewalls are now ready for installation of the remaining risers 18 and the treads 20.

The second riser, and then the remaining treads and risers are installed loose (without cement) as a trial to ensure that the components will properly fit with one another. If this is satisfactory, the risers and treads are removed, and the fixed installation begins.

Using a caulk gun containing the tube 66 of construction adhesive, a bead of the adhesive is applied onto the flat upper surface at the front end of each side wall 14, and onto the top edge of the lowest riser 18A. The construction team now lays the first of the treads 20 on these surfaces, and adjusts the position as necessary to ensure that it is properly overlaying the first riser 18A.

The second riser is installed by first applying a bead of adhesive near the back edge of the first tread 20 and onto the inside edge of the next two vertical surfaces of the sidewalls 14. Then the second riser 18 is applied and is adjusted as needed for proper alignment, and is pressed against the beads of adhesive.

These steps are repeated until the uppermost riser has been installed.

Then starting at the distal or building end, a bead of adhesive is applied to the upper surfaces of the two sidewalls 14 and a tread 20 or platform member 22 is installed and aligned with the marks on the building from the measuring procedure described above. A bead of adhesive is applied to the front edge of this tread or platform member, and to the horizontal top surfaces of the sidewalls, and the next tread or platform member is pushed into place and aligned. This is repeated as necessary until all of the tread members have been installed and the installation is complete. Rails can be installed as needed. A sealer or stain may be applied, as desired.

As usual, a de-icer should never be used with any concrete product.

After installation, sand or crushed stone may be added at the base of each of the sidewalls for long-term stability.

While this embodiment employs elements cast of reinforced concrete, it is possible that at least some of these modules may be made of a composite material, e.g., including fiber and/or tough plastic materials, or may be made of quarried stone. The outer or visible surfaces can be textured as desired, and may be made in any desired color to suit the building or other components of the installation.

An extra-wide step, e.g., up to ten feet in width, can be constructed in this fashion with the addition of a stepped center wall, as depicted, e.g., in FIG. 11 and with two pairs of cross-brace members, one each to be installed between the respective side wall and the center wall.

While the invention is described in terms of a preferred embodiment, the invention is not limited only to that embodiment, but rather many modifications and variations are possible without departing from the main spirit and principles of the invention.

What is claimed is:

1. A modular precast concrete step unit in the form of a kit adapted to be assembled on-site at a remote location, said kit comprising a left precast stepped sidewall and a right precast stepped sidewall, each formed of one or more concrete wall panels, and each having a proximal or lower portion and a distal or higher portion, said stepped sidewalls defining a plurality of alternate vertical and horizontal edge surfaces;

a first rectangular precast concrete riser module dimensioned to extend between said left and right sidewalls and at least a second rectangular precast concrete riser module dimensioned to extend between said left and right sidewalls; said first and said second riser modules being configured to be attached against said vertical edge surfaces;

a plurality of generally rectangular precast concrete tread modules adapted to extend between said left and right sidewalls and to be attached onto said horizontal edge surfaces;

a pair of cross-brace members adapted for joining the left and right side walls within the distal portions thereof, and each said cross-brace member having a foot member at each end thereof with a bolt hole therein to receive a threaded fastener therein;

a plurality of right angle brackets each being in the form of a rigid plate with portions joined at a right angle bend, and each portion having a pair of bolt holes formed therein;

a plurality of threaded fasteners;

each of said side walls having a pair of screw anchors embedded therein at the proximal portion thereof and a pair of screw anchors embedded at the distal portion thereof, and said first riser module having a pair of said screw anchors embedded at each end thereof, the screw anchors being configured to accept said threaded fasteners and fasten to the foot members of said cross-brace members and to receive the threaded fasteners and to fasten said right angle brackets to the proximal portions of said side walls and to the respective ends of said first riser member; and a quantity of a suitable bonding agent for applying to the vertical and horizontal edge surfaces of said stepped side walls for adhering thereto said riser modules and said tread modules, respectively.

2. The precast concrete step unit according to claim 1 comprising additional side panel members to be affixed onto an upper surface of each of said left and right side walls, and flat reinforcing plates adapted to be fastened to said left and right side walls at seams that join the respective side panel members thereof.

3. The precast concrete step unit according to claim 1 wherein the cross-brace members are pivotally joined to one another at mid-portions thereof.

4. The precast concrete step unit according to claim 1 wherein each of said precast modules has a weight of less than 250 pounds.

5. The precast concrete step unit according to claim 1 wherein said bonding agent is a construction adhesive with a tubular container for applying the adhesive with the use of a caulk gun.

6. A precast concrete step unit in the form of a kit adapted to be assembled on-site at a remote location, said kit comprising:

left and right sidewalls and a similar center wall, wherein said left and right sidewalls and said center wall each comprise one or more precast stepped sidewall panel modules;

a plurality of precast concrete tread modules each extending at least between said left and right sidewalls and armed onto respective stepped edge surfaces of said at least one stepped panel module of said right and left sidewalls and said center wall, said left and right sidewalls each having a pair of screw anchors embedded at a distal portion thereof and a pair of screw anchors embedded at a proximal end thereof, and said center wall having respective pairs of screw anchors embedded therein on each side thereof at a distal portion thereof;

a plurality of precast concrete riser modules each extending at least between said right and left sidewalls, and each adapted to extend vertically to successive stepped edge surface of the at least one stepped panel module of each of said right and left sidewalls and said center wall, at least a first of said riser modules having a pair of screw anchors embedded therein at left and right ends thereof;

two pairs of cross-brace members adapted for joining the left side wall and center wall distal portions thereof, and joining said center wall and said right side wall distal portions, and each said cross-brace member having a foot member at each end thereof with a bolt hole therein to receive a threaded fastener therein;

a plurality of right angle brackets each being in the form of a rigid plate with portions joined at a right angle bend, and each portion having a pair of bolt holes formed therein;

a plurality of threaded fasteners;

the screw anchors being configured to accept said threaded fasteners and fasten to the foot members of said cross brace members and to receive the threaded fasteners and to fasten said right angle brackets to the proximal ends of said side walls and to the respective ends of said first riser module; and a quantity of a suitable bonding agent for applying to the vertical and horizontal edge surfaces of said stepped side walls for adhering thereto said riser modules and said tread modules, respectively.

7. The precast concrete step unit according to claim 6 wherein each of said pair of cross-brace members are pivotally joined to one another at mid-portions thereof.

8. The precast concrete step unit according to claim 7 wherein said cross-brace members are arranged along crossed diagonals between the left sidewall and the center wall and between the center wall and the right sidewall.

9. The precast concrete step unit according to claim 6 wherein each of said precast concrete modules has a weight of less than 250 pounds.

* * * * *